US009863585B2

(12) United States Patent
De Jong et al.

(10) Patent No.: US 9,863,585 B2
(45) Date of Patent: Jan. 9, 2018

(54) LIGHT SOURCE ASSEMBLY AND METHOD FOR PRODUCING THE SAME

(71) Applicant: PHILIPS LIGHTING HOLDING B.V., Eindhoven (NL)

(72) Inventors: Boudewijn Ruben De Jong, Eindhoven (NL); Johannes Wilhelmus Weekamp, Beek en Donk (NL); Paul Dijkstra, Eindhoven (NL); Marc Andre De Samber, Lommel (BE); Hendrik Jan Eggink, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 225 days.

(21) Appl. No.: 14/887,626

(22) Filed: Oct. 20, 2015

(65) Prior Publication Data

US 2016/0109110 A1 Apr. 21, 2016

(30) Foreign Application Priority Data

Oct. 21, 2014 (EP) ..... 14189741

(51) Int. Cl.
*F21K 9/232* (2016.01)
*F21K 9/90* (2016.01)
(Continued)

(52) U.S. Cl.
CPC ..... *F21K 9/232* (2016.08); *F21K 9/90* (2013.01); *F21V 29/50* (2015.01); *F21Y 2107/50* (2016.08);
(Continued)

(58) Field of Classification Search
CPC ... F21K 9/00; F21K 9/20; F21K 9/232; F21K 9/66; F21K 9/90; F21V 23/006;
(Continued)

(56) References Cited

U.S. PATENT DOCUMENTS 8,506,103 B2 * 8/2013 Iimura ..... F21V 7/041 362/254
8,690,374 B2 * 4/2014 Miller ..... F21V 15/01 362/101
(Continued)

FOREIGN PATENT DOCUMENTS

CN 102434807 A 5/2012
DE 10029069 A1 1/2002
(Continued)

*Primary Examiner* — Hargobind S Sawhney
(74) *Attorney, Agent, or Firm* — Akarsh P. Belagodu

(57) ABSTRACT

A light source assembly, a method for producing a light source assembly, and a lamp are provided. In one example, the light source assembly comprises a substrate comprising first and second substrate portions being arranged at a tilt angle (α) to each other forming a V-shaped structure, wherein, at the tip of the V-shaped structure, the first portion comprises a first electrical terminal and the second portion comprises a second electrical terminal. The light source assembly further comprises a light source arranged to bridge a terminal gap between the first and second electrical terminals such that the light source is in electrical connection with the first and second electrical terminals.

15 Claims, 3 Drawing Sheets

(51) Int. Cl.

| | |
|---|---|
| *F21Y 115/10* | (2016.01) |
| *F21V 29/50* | (2015.01) |
| *F21Y 107/50* | (2016.01) |
| *F21Y 107/70* | (2016.01) |

(52) U.S. Cl.
CPC ..... *F21Y 2107/70* (2016.08); *F21Y 2115/10* (2016.08)

(58) Field of Classification Search
CPC ..... F21V 3/00; F21Y 2107/50; H05K 1/14; H05K 1/145; H05K 1/148; H05K 2201/10106
See application file for complete search history.

(56) References Cited

U.S. PATENT DOCUMENTS 8,794,796 B2 * 8/2014 Lee ..... F21V 23/006 362/249.02
9,644,799 B2 * 5/2017 Crayford ..... F21V 23/045
2009/0290347 A1 * 11/2009 Lodhie ..... F21K 9/00 362/249.02
2011/0163675 A1 * 7/2011 Lin ..... F21V 3/00 315/113
2012/0320591 A1 12/2012 Liao et al.
2015/0015142 A1 * 1/2015 Chu ..... F21K 9/90 315/51
2015/0131327 A1 * 5/2015 Dau ..... F21K 9/235 362/646
2015/0221851 A1 * 8/2015 Biggs ..... H01L 41/0836 310/328

FOREIGN PATENT DOCUMENTS

KR 1325080 B1 11/2013
WO 2013179227 A2 12/2013
WO 2014049916 A1 4/2014

* cited by examiner

LIGHT SOURCE ASSEMBLY AND METHOD FOR PRODUCING THE SAME

FIELD OF THE INVENTION

The present invention relates to a light source assembly and to a method for manufacturing such a light source assembly. The invention also relates to a lamp comprising such a light source assembly.

BACKGROUND OF THE INVENTION

For many type of light source assemblies heat spreading and heat exchange of the heat generated by a light source, such as a LED, of the light source assembly rely on the size of the substrate onto which the light source is assembled and the heat exchange between the substrate and the gas surrounding the light source assembly. This is especially true for light source assemblies arranged within an envelope in the form of a bulb, e.g. a light bulb. For such a bulb design the heat exchange between the light source assembly and the surroundings rely on the mere heat exchange between the substrate acting as a heat spreader and the gas enclosed in the bulb as well as thermal radiation, as heat management through conduction along wire (stem) connections is largely negligible.

For proper heat exchange of heat generated by the light source sufficient surface of the substrate acting as the heat spreader is needed. Also a good thermal interface between light source and the heat spreader is required. Prior art rely on a large substrate surface around the light source for enhancing the heat exchange between the substrate acting as a heat spreader and the gas. However, such a set-up will block light from the light source that is directed towards the surface of the substrate.

SUMMARY OF THE INVENTION

It is an object of the present invention to provide a light source assembly having efficient heat dissipating properties while minimizing loss of light being emitted from the light source of the light source assembly.

According to a first aspect of the invention a light source assembly is provided. The light source assembly comprising: a substrate comprising first and second substrate portions being arranged at a tilt angle to each other forming a V-shaped structure, wherein, at the tip of the V-shaped structure, the first substrate portion comprises a first electrical terminal and the second substrate portion comprises a second electrical terminal; and a light source arranged to bridge a terminal gap between the first and second electrical terminals such that the light source is in electrical connection with the first and second electrical terminals.

The wording V-shaped structure should be construed in its broadest sense as a structure comprising a kinked portion such that a kink of a curve is formed. In other words the V-shaped structure may comprise straight or bent portions at or near its apex. For a planar or plate shaped substrate the V-shaped structure may, moreover, be understood as the dihedral angle between the first and the second substrate portions.

The first and second substrate portions forming the V-shaped structure provide a supporting surface for the light source. Mounting the light source at the tip of the V-shaped-structure reduces the blocking, by the substrate, of light emitted from the light source. Hence, the substrate completely resides under the light source, without blocking of light originating from the top or sides of the light source. This is especially beneficial for a light source having a high amount of sideways light emission. Moreover, the first and second substrate portions also have a very good thermal interconnect to the light source via the electrical terminals. The potentially large surface of the first and second substrate portions facilitates optimum heat-spreading and -exchange to the surroundings of the light source assembly. Hence, blockage of light emitted from the light source is minimized and at the same time sufficient heat spreading and exchange is provided for. Moreover, this is made possible using a conventional and cheap substrate.

The first and second substrate portions may comprise a light source supporting surface, wherein the first and second electrical terminals are arranged at the respective light source supporting surface. This further facilitates the assembly of the light source to the tip of the V-shapes structure.

The first and second substrate portions may be separated by a gap at the tip of the V-shaped structure, wherein the light source is arranged to bridge the gap. This provides for that heat from the light source may be more easily spread to both the upper and lower surfaces of the first and second substrate portions.

The light source assembly may further comprise a mechanical support supporting the first and second substrate portions. This provide for a stable light source assembly. The mechanical support may also be used as a heat dissipator and heat exchanger surface.

The tilt angle may be acute. This further minimizes the blocking of light emitted from the light source.

Each of the first and second substrate portions may comprise a conductor, wherein a portion of the respective conductor forms the first and second electrical terminals. The conductor is working as a heat dissipator and heat exchanger and further enhances the thermal properties of the light source assembly. The conductors are preferable arranged as surface conductors arranged as an outer most layer of the substrate. The potentially large surface of the conductors facilitates optimum heat-spreading and -exchange to the surroundings of the light source assembly.

According to a second aspect of the invention a method for producing a light source assembly is provided. The method comprising: providing a substrate comprising a conducting path and a score line, the score line being arranged across the conducting path and such that the substrate is foldable about the score line; folding the substrate about the score line forming a V-shaped structure; removing, along the score line, a portion from the folded substrate such that a first substrate portion and a second substrate portion are formed and such that the conducting path is split whereby a first electrical terminal located at the first substrate portion and a second electrical terminal located at the second substrate portion are formed; arranging a light source in electrical connection with the first and second electrical terminals such that the light source bridge a terminal gap between the first and second electrical terminals and such that the light source is in electrical connection with the first and second electrical terminals.

Accordingly a support onto which the light source is arranged is easily being produced by folding the substrate and thereafter removing a portion of the substrate. The removing may e.g. be made by cutting the substrate in half By removing the portion of the substrate, a mounting surface (or mounting surfaces) is (are) exposed onto which the light source is assembled. By removing the portion of the substrate such that the conducting path is split production of the electrical terminal is facilitated. Arranging the light source at the tip of the V-shaped-structure reduces the blocking, by the substrate, of light emitted from the light source. Hence, the substrate completely resides under the light source, without blocking of light originating from the top or sides of the light source. Moreover, the first and second substrate portions also have a very good thermal interconnect to the light source via the electrical terminals. The potentially large surface of the first and second substrate portions facilitates optimum heat-spreading and -exchange to the surroundings of the light source assembly. Hence, blockage of light emitted from the light source is minimized and at the same time sufficient heat spreading and exchange is provided for. Moreover, this is made possible using a conventional and cheap substrate.

Moreover, the details and advantages discussed in connection with the first aspect and the embodiments thereof apply correspondingly to this second aspect of the present invention. For brevity, the discussion will therefore not be repeated here.

According to a third aspect of the invention a lamp comprising a e.g. bulb-shaped envelope; and a light source assembly according to the first aspect or a light source assembly produced according to the second aspect is provided. The light source assembly is arranged within the bulb-shaped envelope. The details and advantages discussed in connection with the first and second aspects and the embodiments thereof apply correspondingly to this third aspect of the present invention. For brevity, the discussion will therefore not be repeated here.

It is noted that the invention relates to all possible combinations of features recited in the claims.

BRIEF DESCRIPTION OF THE DRAWINGS

This and other aspects of the present invention will now be described in more detail, with reference to the appended drawings showing embodiments of the invention. As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

In connection with FIGS. 1-4 the production of light source assembly 1 according to the present invention will be described. The light source assembly 1 being produced from a substrate 10 and one or more light sources 20. The light source 20 may be a LED. The substrate 10 is here plate shaped, but may in other embodiments comprise curved portions.

Figure 1:
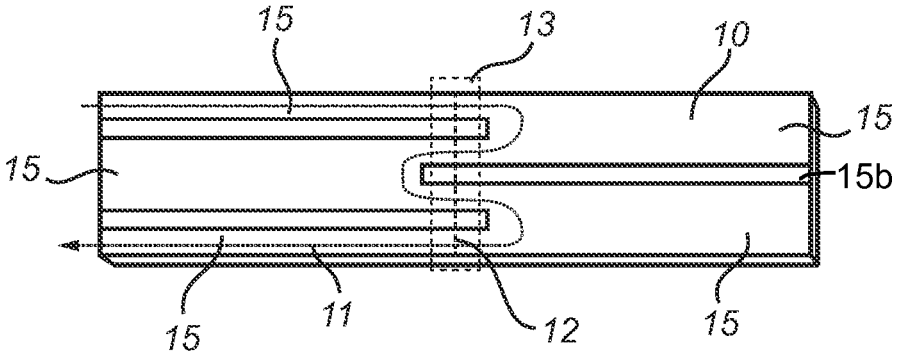
FIG. 1 is a top view of the substrate used for producing a light source assembly according to the present invention.

In FIG. 1 an embodiment of a substrate 10 used for producing the light source assembly 1 according to the present invention is illustrated. The substrate 10 comprises a score line 12 and a conductor 15. Electrically isolating portions 15*b* are further provided to electrically isolate regions of the conductor for efficient shielding and powering of the light sources 20 of the light source assembly 1.

According to this embodiment the conductor 15 is arranged on top of a substrate material. That is, the conductor 15 is according to this embodiment arranged as a conductor surface on the substrate material. Hence, the conductor 15 is forming an outer or inner layer arranged on the substrate material.

The substrate material may e.g. be a metal sheet (e.g. lead-frame made of copper, aluminum), printed circuit board (PCB) based on Flame Retardant 4 (FR-4), Composite Epoxy Materials (CEM-1, CEM-3), Insulated Metal Substrate (IMS), Metal Core PCB (MCPCB), polyimide based foils/sheets (e.g. Kapton®), a metal sheet coated with silver, an aluminum sheet with dielectric, ceramic material based PCB, glass based PCB.

The conductor 15 is formed of an electrically and thermally conductive material. By forming the conductor 15 of a thermally conductive material the conductor is working as an efficient heat spreader. Moreover, by arranging the conductor 15 at the surface of the substrate 10 efficient heat exchange with the surroundings may be achieved. The conductor 15 is according to this embodiment formed by a metal. Non-limiting examples of metals to be used are Copper, Aluminum, or Silver. However, other electrically and thermally conductive materials may also be used for the conductor 15. Non-limiting examples of such materials are conductive pastes, inks, glues (silver or copper based). The conductor 15 is forming an electrically conducting path 11.

The electrically isolating portions 15*b* may further improve the thermal heat management of the light source assembly 1. Improved thermal spreading may be achieved by using electrically isolating portions 15*b* having relatively higher emissivities as compared to the conductor material(s). As a result, heat transferred to the electrically isolating portions 15*b* may be effectively lead away from the light source assembly 1 by heat radiation.

The score line 12 being arranged across the conducting path 11. The substrate 10 is foldable about the score line 12. The score line may be formed as a weakening in the substrate 10 about which the substrate 10 is foldable. The score line may be formed by milling, laser milling, V-groove cutting, drilling and other similar techniques known to the skilled person in the art. The score line may further comprise indentations.

Figure 2:
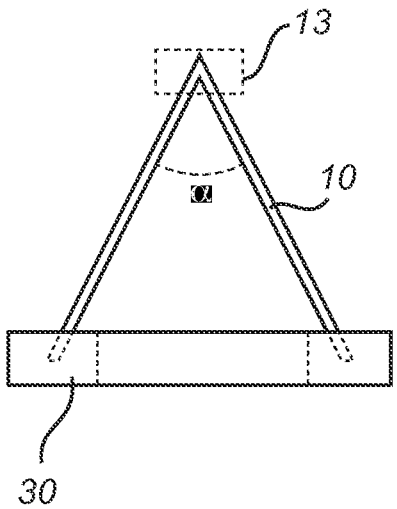
FIG. 2 is a side view of the substrate of FIG. 1 after folding of the same.

In FIG. 2 the substrate 10 is shown after it has been folded about the score line 12. After folding the substrate 10 it forms a V-shaped structure. The V-shapes structure is having a tilt angle $\alpha$. The tilt angle $\alpha$ is preferably but not necessarily acute forming an acute tip of the V-shaped structure.

As being illustrated in FIG. 2 the folded substrate 10 may be assembled into a mechanical support 30 supporting the substrate 10. The mechanical support 30 may comprise openings (not shown). The openings allow for enhanced circulation of gas passing a finally assembled light source assembly 1. It is to be realized that the mechanical support 30 is not necessary for the function of the light source assembly according to the present invention.

Figure 3:
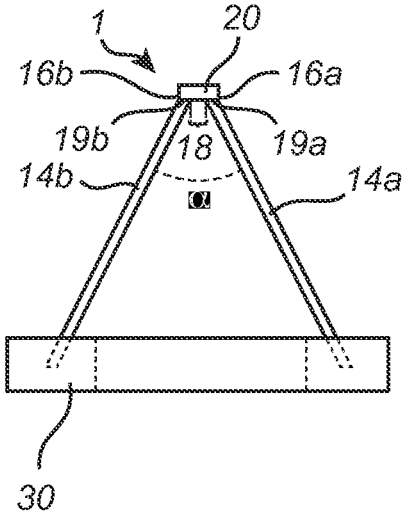
FIG. 3 is a side view of a light source assembly according to the present invention.

As illustrated in FIG. 3, by removing a portion 13 of the folded substrate 10 a first substrate portion 14*a* and a second substrate portion 14*b* are formed. The portion 13 being removed from the folded substrate 10 is located at the tip of the V-shaped structure. Hence, the removed portion 13 of the substrate 10 is a portion of the substrate 10 along the score line 12. The portion 13 to be removed is chosen such that the conducting path 11 is split. Thereby a first electrical terminal 16*a* and a second electrical terminal 16*b* are formed. The first electrical terminal 16*a* is located at the first substrate portion 14*a*. The second electrical terminal 16*b* is located at the second substrate portion 14*b*. Moreover, portion 13 to be removed is chosen such that first and second light source supporting surfaces 19*a*, 19*b* are formed. The first light source supporting surface 19*a* is located at the first substrate portion 14*a*. The second light source supporting surface 19*b* is located at the second substrate portion 14*b*. Hence, the first and second electrical terminals 16*a*, 16*b* are arranged at the respective light source supporting surface 19*a*, 19*b*. The first and second light source supporting surfaces 19*a*, 19*b* are parallel. The light source 20 of the light source assembly 1 is arranged at the first and second light source supporting surfaces 19*a*, 19*b*. The first and second light source supporting surfaces 19*a*, 19*b* are forming a support surface for supporting the light source 20. The light source 20 is arranged at the tip of the V-shaped structure. Hence, the substrate 10 completely resides under the lights source without blocking of light originating from the top or sides of the light source 20. The light source 20 is assembled to bridge a terminal gap between the first and second electrical terminals 16*a*, 16*b*. Moreover, the light source 20 is in electrical connection with the first and second electrical terminals 16*a*, 16*b*.

The electrical terminals 16*a*, and 16*b* may comprise a solderable material or a portion of solderable material allowing for proper electrical conduction to be established between the electrical terminals 16*a*, and 16*b* at the light source 20 by soldering the light source 20 to the electrical terminals 16*a*, and 16*b*. The solderable material may for example comprise Cu, Al, NiAu, NiPdAu or other materials which are solderable. The wording solderable material should here be understood as a material at which a soldered joint may be formed which allows for proper electrical conduction. The soldering may further provide efficient thermal transport.

According other embodiments the connection between the electrical terminals 16*a*, and 16*b* and the light source 20 can be established by gluing with conductive glue, e.g. silver-filled epoxy.

As illustrated in the embodiment of FIG. 3 the portion 13 to be removed may be chosen such that a gap 18 between the first and second substrate portion 14*a*, 14*b* is formed. Hence, the gap 18 is arranged at the tip of the V-shaped structure. The light source 20 is arranged to bridge the gap 18. It is however to be realized that for some embodiments of the present invention no gap between the first and second substrate portion 14*a*, 14*b* is formed after removal of the portion 13 of the substrate 10 at the tip of the V-shaped structure. This as long as after the removal of the portion 13 of the substrate 10 at the tip of the V-shaped structure, the conducting path 11 is split forming the first and second electrical terminals 16*a*, 16*b*.

According to other embodiments the substrate may be formed by a layer being a conductor, e.g. copper or aluminum. The conductor is having both heat spreading and heat exchanging properties. Hence, according to these embodiments the substrate does not comprise the substrate material, the substrate is formed solely by the conductor.

According to other embodiments the substrate may further be coated bye an additional layer arranged to be in contact with the conductor and at least partly cover the conductor. The additional layer may be used in combination with any embodiment of the substrate of the present invention. The additional layer may provide additional electrical insulation such that the conductor is at last partly electrically isolated from its environment.

The additional layer may alternatively or additionally provide mechanical support to the substrate such that the mechanical stability of the light source assembly is improved. A more durable light source assembly is thereby obtained. The additional layer may further provide additional heat spreading by for example thermal emission and/or provide a light reflection surface which improves the efficiency of the light source assembly.

The additional layer may comprise an organic coating, an inorganic coating, and/or a metal coating.

Figure 4:
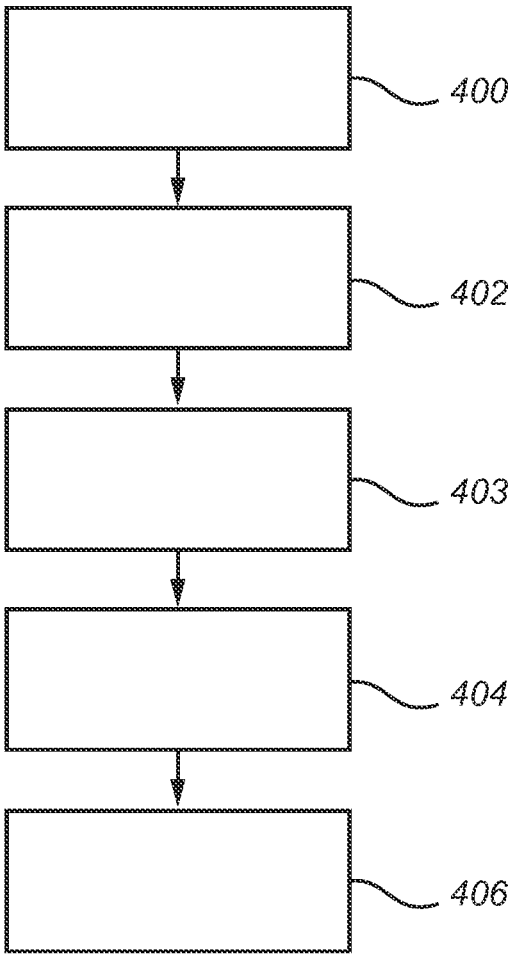
FIG. 4 is a block diagram of a method for producing a light source assembly according to the present invention.

FIG. 4 is a block diagram of the method for producing the light source assembly 1. The method comprising the following acts. Providing 400 a substrate 10 comprising a conducting path 11 and a score line 12. The score line 12 being arranged across the conducting path 11 and such that the substrate 10 is foldable about the score line (12). Folding 402 the substrate 10 about the score line 12 forming a V-shaped structure. Removing 404, along the score line 12, a portion 13 from the folded substrate 10 such that a first substrate portion 14*a* and a second substrate portion 14*b* are formed and such that the conducting path 11 is split whereby a first electrical terminal 16*a* located at the first substrate portion 14*a* and a second electrical terminal 16*b* located at the second substrate portion 14*b* are formed. Arranging 406 a light source 20 in electrical connection with the first and second electrical terminals 16*a*, 16*b* such that the light source 20 bridge a terminal gap between the first and second electrical terminals 16*a*, 16*b* and such that the light source 20 is in electrical connection with the first and second electrical terminals 16*a*, 16*b*. The folding 402 of the substrate 10 about the score line 12 may be performed until the tip of the V-shaped structure is acute.

The method may further comprise assembling 403 the folded substrate 10 into a mechanical support 30.13. Said removing 404 of material may be performed after said assembling 403 of the folded substrate 10 into the mechanical support 30.

Figure 5:
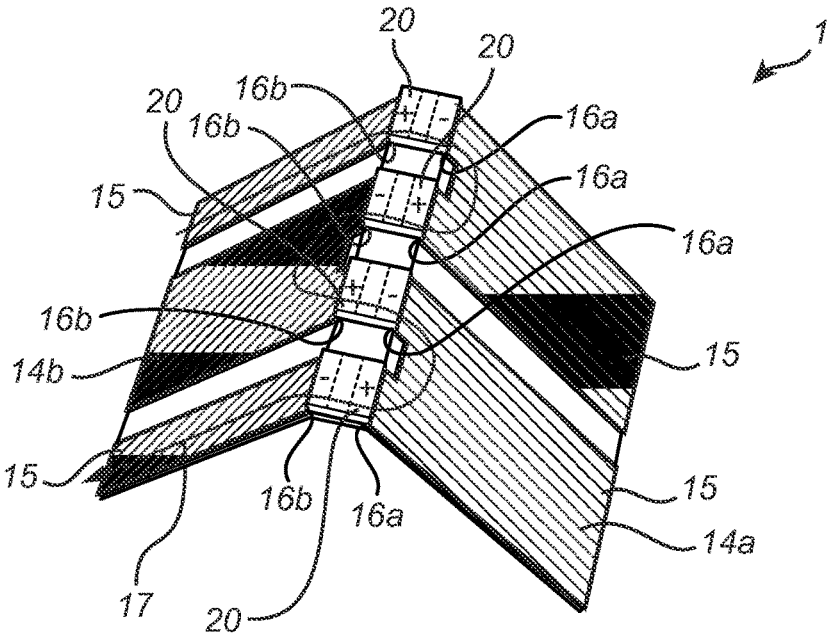
FIG. 5 is a top view of a light source assembly according to the present invention.

In FIG. 5 an embodiment of an assembled light source assembly 1 is illustrated. In the embodiment illustrated in FIG. 5 four first electrical terminals 16*a* are arranged at the first substrate portion 14*a* and four second electrical terminals 16*b* are arranged at the second substrate portion 14*b* forming four different electrical terminal gaps wherein a light source 20 is arranged to bridge each of the electrical terminal gaps. However, it is to be understood that the present invention is directed towards any number of first and second electrical terminals for forming terminal gaps to be bridged light source(s). Under operation of the light source assembly 1 an electrical current 17 is arranged to run through the conductors 15 and the light sources 20 for powering the later.

The light source assembly comprises a substrate 10 comprising first and second substrate portions 14*a*, 14*b* being arranged at a tilt angle $\alpha$ to each other forming a V-shaped structure. At the tip of the V-shaped structure, the first portion comprises 14*a* a first electrical terminal 16*a* and the second portion 14*b* comprises a second electrical terminal 16*b*. The Light source assembly further comprises a light source 20 arranged to bridge the terminal gap between the first and second electrical terminals 16*a*, 16*b* such that the light source 20 is in electrical connection with the first and second electrical terminals 16*a*, 16*b*.

Figure 6:
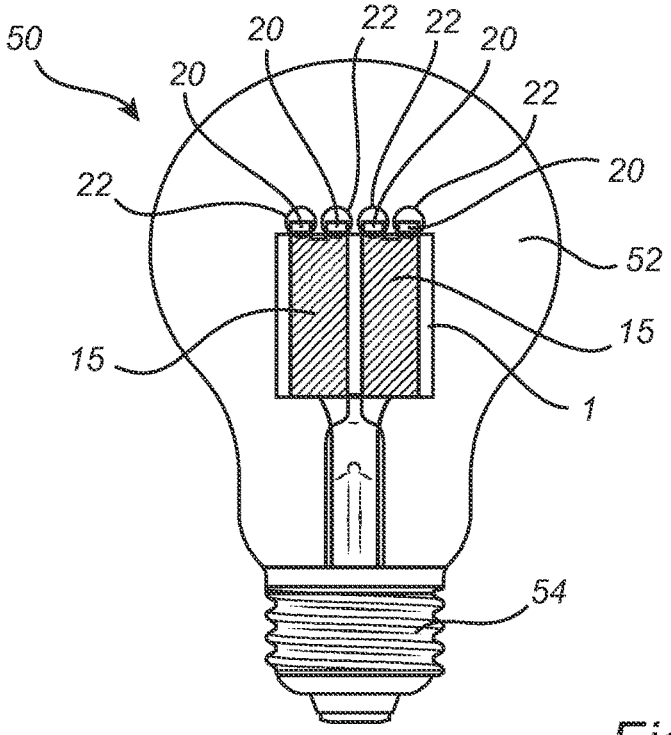
FIG. 6 is a side view of a lamp comprising a light source assembly according to the present invention.

In FIG. 6 a lamp 50 comprising a light source assembly 1 according to the present invention is illustrated. The lamp 50 further comprises a bulb-shaped envelope 52 and a base 54. The light source assembly 1 is arranged within the bulb-shaped envelope 52. The base 54 is arranged to be inserted into a socket of a luminaire in order to provide support for the lamp 50. Moreover, the base 54 is arranged to provide an electrical current to the lamp 50 for driving the light source within the lamp 50. The light source assembly 1 is arranged in electrical contact with the base 54 for driving the light source 20 of the light source assembly 1.

The person skilled in the art realizes that the present invention by no means is limited to the preferred embodiments described above. On the contrary, many modifications and variations are possible within the scope of the appended claims.

For example, one or more light source(s) 20 may be used in the light source assembly 1.

Further, as illustrated in FIG. 6, an optical element 22 may be arranged at the light source(s) 20 for controlling light emitted from the light source(s) 20. The optical element 22 may comprise lens(es) and/or reflector(s) for directing light from the light source(s) 20 and/or phosphor(s) for converting light from the light source(s) 20.

Furthermore, the first and second substrate portions 14*a*, 14*b* may comprise circuitry for controlling the light source(s) 20.

As illustrated in FIG. 1 the layout of the conducting path 11 is being dependent upon the layout of the conductor surface 15 of the substrate 10. In FIG. 1 a specific layout is shown. However, the person skilled in the art realizes that various layouts are equally possible. For example the conductor surface 15 of the substrate 10 may be designed such that it exhibits a plurality of conducting paths.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. Light source assembly, comprising:

a substrate comprising first and second substrate portions being arranged at a tilt angle to each other forming a V-shaped structure, wherein, at the tip of the V-shaped structure, the first substrate portion comprises a first electrical terminal and the second substrate portion comprises a second electrical terminal; and a light source arranged to bridge a terminal gap between the first and second electrical terminals such that the light source is in electrical connection with the first and second electrical terminals.

2. Light source assembly according to claim 1, wherein each of the first and second substrate portions comprises a light source supporting surface, wherein the first and second electrical terminals are arranged at the respective light source supporting surface.

3. Light source assembly according to claim 1, wherein the light source supporting surfaces are parallel.

4. Light source assembly according to claim 1, wherein the first and second substrate portions being separated by a gap at the tip of the V-shaped structure, and wherein the light source is arranged to bridge the gap.

5. Light source assembly according to claim 1, further comprising a mechanical support supporting the first and second substrate portions.

6. Light source assembly according to claim 5, wherein the mechanical support is arranged at the opening of the V-shaped structure.

7. Light source assembly according to claim 1, wherein the tilt angle ($\alpha$) is acute.

8. Light source assembly according to claim 7, wherein each of the first and second substrate portions comprises a conductor, wherein a portion of the respective conductor forms the first and second electrical terminals.

9. Light source assembly according to claim 1, further comprising an optical element arranged at light source for controlling light emitted from the light source.

10. Light source assembly according to claim 1, wherein the light source comprises a LED.

11. A lamp, comprising;

a bulb-shaped envelope; and a light source assembly according to claim 1, wherein the light source assembly is arranged within the bulb-shaped envelope.

12. Method for producing a light source assembly, the method comprising:

providing a substrate comprising a conducting path and a score line, the score line being arranged across the conducting path and such that the substrate is foldable about the score line;

folding the substrate about the score line forming a V-shaped structure;

removing, along the score line, a portion from the folded substrate such that a first substrate portion and a second substrate portion are formed and such that the conducting path is split whereby a first electrical terminal located at the first substrate portion and a second electrical terminal located at the second substrate portion are formed;

arranging a light source in electrical connection with the first and second electrical terminals such that the light source bridge a terminal gap between the first and second electrical terminals and such that the light source is in electrical connection with the first and second electrical terminals.

13. Method according to claim 12, further comprising assembling the folded substrate into a mechanical support.

14. Method according to claim 12, wherein said removing of material is performed after said assembling of the folded substrate into the mechanical support.

15. Method according to claim 12, wherein said folding is performed until the tip of the V-shaped structure is acute.

* * * * *